US007597390B2

(12) United States Patent
Galati, Jr. et al.

(10) Patent No.: US 7,597,390 B2
(45) Date of Patent: Oct. 6, 2009

(54) CHAIR FOR A FOOT SPA

(75) Inventors: Joseph J. Galati, Jr., Brookfield, WI (US); John Meyerovich, Bal Harbour, FL (US)

(73) Assignee: Continuum Footspas, LLC, Brookfield, WI (US)

( * ) Notice: Subject to any disclaimer, the term of this patent is extended or adjusted under 35 U.S.C. 154(b) by 0 days.

(21) Appl. No.: 11/983,832

(22) Filed: Nov. 13, 2007

(65) Prior Publication Data

US 2009/0121527 A1 May 14, 2009

(51) Int. Cl.

| | |
|---|---|
| ***A47D 15/00*** | (2006.01) |
| ***A47C 7/62*** | (2006.01) |
| ***A47C 1/00*** | (2006.01) |
| ***A47K 3/022*** | (2006.01) |

(52) U.S. Cl. ..... 297/182; 297/217.4; 297/327; 297/344.24; 4/578.1

(58) Field of Classification Search ..... 297/182, 297/217.5, 217.4, 327, 344.24, 344.21, 344.11, 297/344.1; 4/578.1, 547

See application file for complete search history.

(56) References Cited

U.S. PATENT DOCUMENTS

| | | | | |
|---|---|---|---|---|
| D166,402 | S | 4/1952 | Manne et al. | |
| D227,952 | S | 7/1973 | Costabile et al. | |
| D282,609 | S | 2/1986 | Stulik | |
| D288,993 | S | 3/1987 | Grimsrud | |
| 5,143,055 | A * | 9/1992 | Eakin | 601/47 |
| D346,043 | S | 4/1994 | Galati, Jr. et al. | |
| 5,314,403 | A * | 5/1994 | Shaw | 601/148 |
| D391,408 | S | 3/1998 | Lee | |
| D424,819 | S | 5/2000 | Galati, Jr. et al. | |
| D434,916 | S | 12/2000 | Galati, Jr. et al. | |
| D435,371 | S | 12/2000 | Galati, Jr. et al. | |
| 6,503,212 | B2 * | 1/2003 | Park | 601/158 |
| 6,732,387 | B1 | 5/2004 | Waldron | |
| D498,599 | S | 11/2004 | Luong | |
| 6,880,182 | B2 | 4/2005 | Gruenwald | |
| D508,616 | S | 8/2005 | Ziliani | |
| D509,371 | S | 9/2005 | Natuzzi | |
| D526,505 | S | 8/2006 | Gruenwald et al. | |
| D531,420 | S | 11/2006 | Kita | |
| 7,168,107 | B2 | 1/2007 | Gruenwald | |
| D541,060 | S | 4/2007 | Fugate et al. | |
| D548,987 | S | 8/2007 | McNae | |
| D559,570 | S | 1/2008 | Higgs et al. | |
| D568,485 | S | 5/2008 | Ton | |
| D574,502 | S | 8/2008 | Ton | |
| 2004/0177438 | A1 | 9/2004 | Gruenwald et al. | |

(Continued)

OTHER PUBLICATIONS

AmeriSpa web pages, printed in 2007, 6 pages (http://www.amerispa.com/main.html).

(Continued)

*Primary Examiner*—Milton Nelson, Jr.
(74) *Attorney, Agent, or Firm*—Ryan Kromholz & Manion, S.C.

(57) ABSTRACT

A spa device including a chair coupled to a frame and at least one tactile immersion sounds delivery device. The chair is rotatably, slidably, and tiltably coupled to the frame. The spa device may include electronic controls for controlling the movement of the seat and the operation of the tactile immersion sound deliver devices.

10 Claims, 4 Drawing Sheets

U.S. PATENT DOCUMENTS

| | | | |
|---|---|---|---|
| 2004/0244107 | A1 | 12/2004 | Waldron |
| 2005/0183198 | A1 | 8/2005 | Gruenwald |
| 2007/0226897 | A1 | 10/2007 | Fugate |

OTHER PUBLICATIONS

Belvedere Company web pages, printed in 2007, 7 pages (http://www.belvedere.com/home.aspx).
European Touch web pages, printed in 2007, 8 pages (http://europeantouch.com).
Gulstream Plastics Ltd. web pages, printed in 2007, 7 pages (http://www.gulfstreamplastic.com).
J&A USA web pages, printed in 2007, 10 pages (http://www.jausainc.com).
Lexor Footspas Inc. web pages, printed in 2007, 3 pages (http://www.lexorinc.com).
Salon Equipment, Inc. web pages, printed in 2007, 4 pages (http://www.oasis-se.com/spas/).
ProSpa Inc., web pages, printed in 2007, 2 pages (http://www.prospa1.com/).
Salon Tech, web pages, printed in 2007, 2 pages (http://www.salontech.com/st2007/).
Skyline Beauty Supply Corp.—Whale Spa, web pages, printed Mar. 20, 2008, 6 pages (http://skylinebeautysupply.com).
VNF International, web pages, printed Mar. 20, 2008, 6 pages (http://www.pssnell-service.com/Manufacturer.htm).
T4 Spa Concepts & Design, web pages, printed Mar. 20, 2008, 7 pages (http://www.t4spa.com).
Spa Zi, Division of LC Corp., web pages, printed Mar. 20, 2008, 4 pages (http://www.thespazi.com).
Sanijet—Pipeless Pedicure Equipment, web pages, printed Mar. 20, 2008, 2 pages (http://www.sanijet.com/Products Pedicure.aspx).
Aqua Spas, web pages, printed Mar. 20, 2008, 3 pages (http://aquaspa1.com).
Beauty Mall Ltd., web pages, printed Mar. 20, 2008, 6 pages (http://beautymallltd.com).
Euro Spa, web page, printed Mar. 20, 2008, 1 page (http://www.princesspedicurespas.com/manufacturer/eurospa.html#bella320).
Solojet, web page, printed in 2007, 1 page (http://solojet.com).
Hydro Systems—The Solo, web page, printed in 2007, 2 pages (back to back) (http://www.hydrosystem.com/hydro4/designer/solo/).
SO Sound Solutions, web page, printed in 2007, 1 page (http://www.sosounsolutions.com/).

* cited by examiner

CHAIR FOR A FOOT SPA

BACKGROUND OF THE INVENTION

It is known to provide spa devices such as health spas, whirlpools, and foot spas. In particular, it is known that the treatment of a person's foot may provide therapeutic relief to various points throughout the body. Such spa devices are generally used in commercial and recreational setting for hydrotherapy, massage, stimulation, pedicure and bathing purposes.

Such spa devices may be used for spa treatments of both therapeutic and aesthetic varieties.

Many spa devices currently on the market have chairs which are not adjustable. This may lead to decreased comfort in patients. It is therefore desirable to provide a spa device with an adjustable chair.

SUMMARY OF THE INVENTION

The present invention provides a spa device including a chair, a frame coupled to the chair and at least one tactile immersion sound delivery device coupled to the chair.

The chair maybe rotatably coupled to the frame. The chair may be rotatably coupled to the frame through a motion device.

The chair may be slidably coupled to the frame. The spa device may include at least one upper rail coupled to the chair at least lower rail coupled to the motion device. The lower rail is sized and configured for sliding engagement with the upper rail.

The chair may be tiltably coupled to the frame. A pivoting member may be coupled to the frame with a pair of arm members coupled to the pivoting member.

The chair may include a seat portion and a back portion coupled to the seat portion. The chair may include a first tactile immersion sound delivery device coupled to the seat portion and a second tactile immersion sound delivery device coupled to the back portion.

A spa device according to the present invention may include a chair, a motion device coupled to the chair and operably connected to a controller, a frame coupled to the motion device, at least one controller operably connected to the motion device and adapted to operate the motion device, at least one operator input device operably connected to the controller and adapted to provide input to the controller, and at least one power source operably connected to the controller.

The motion device may include a first pair of rails coupled to said chair, a second pair of rails coupled to the frame and sized and configured for slidable engagement with the first pair of rails, and a motor coupled to the first pair of rails and operably connected to the controller. The controller may be adapted to operate the motor to operate the motion device.

The motion device may also include a pivoting member coupled to the frame, a pair of arm members coupled to the pivoting member, and at least one motor coupled to the pivoting member and operably connected to the controller.

The spa system may also include at least one tactile immersion sound delivery device coupled to the chair and operably connected to a controller. The controller may be adapted to operate the at least one tactile immersion sound delivery device.

The operator input device may be coupled to the chair. The operator input device may be adapted to provide input to the controller to operate the motion device and the tactile immersion sound delivery device.

The spa system may include a basin coupled to the frame and a second operator input device coupled to the basin. The second operator input device may be adapted provide input to the controller to operate the motion device.

The invention provides a spa system including a chair, a frame coupled to the chair, means for rotating the chair relative to the frame, means for tilting the chair relative to the frame; and means for sliding the chair relative to the frame.

The spa system may also include means for providing one tactile immersion sound delivery to the chair.

DESCRIPTION OF THE PREFERRED EMBODIMENT

Figure 1:
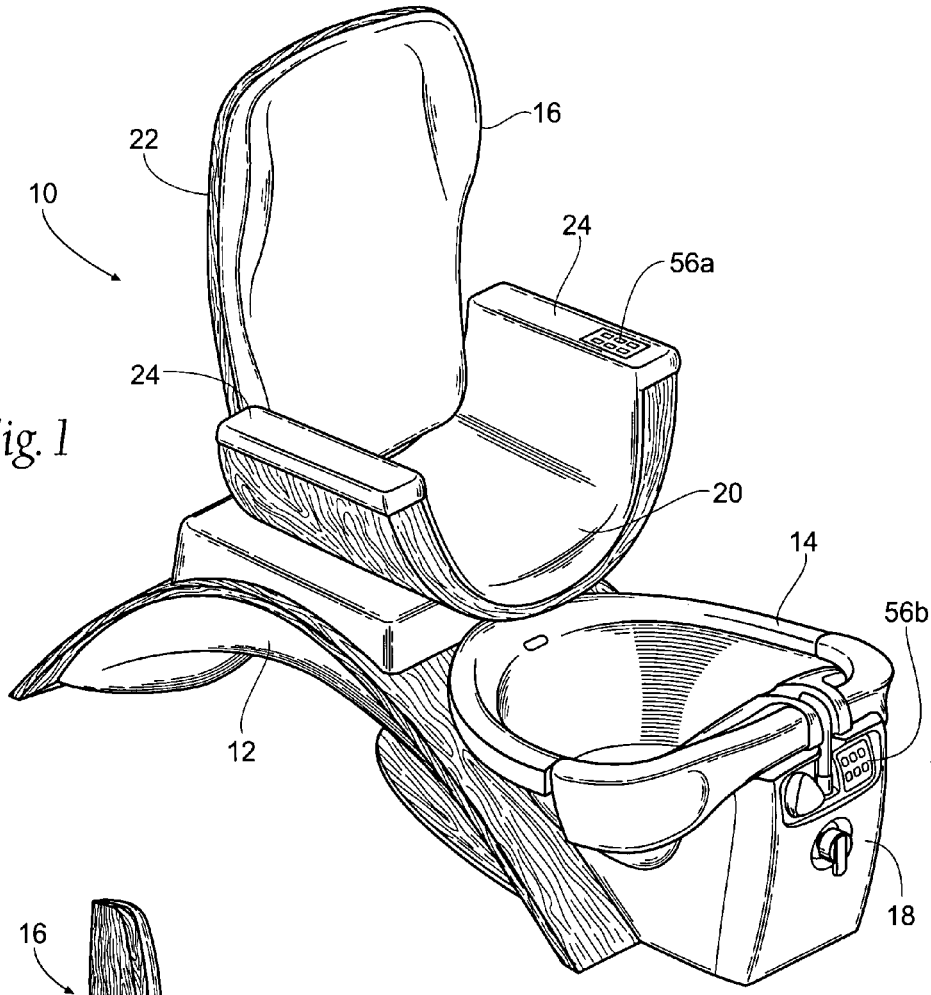
FIG. 1 is a perspective view of an embodiment of a foot spa according to the present invention.
Figure 2:
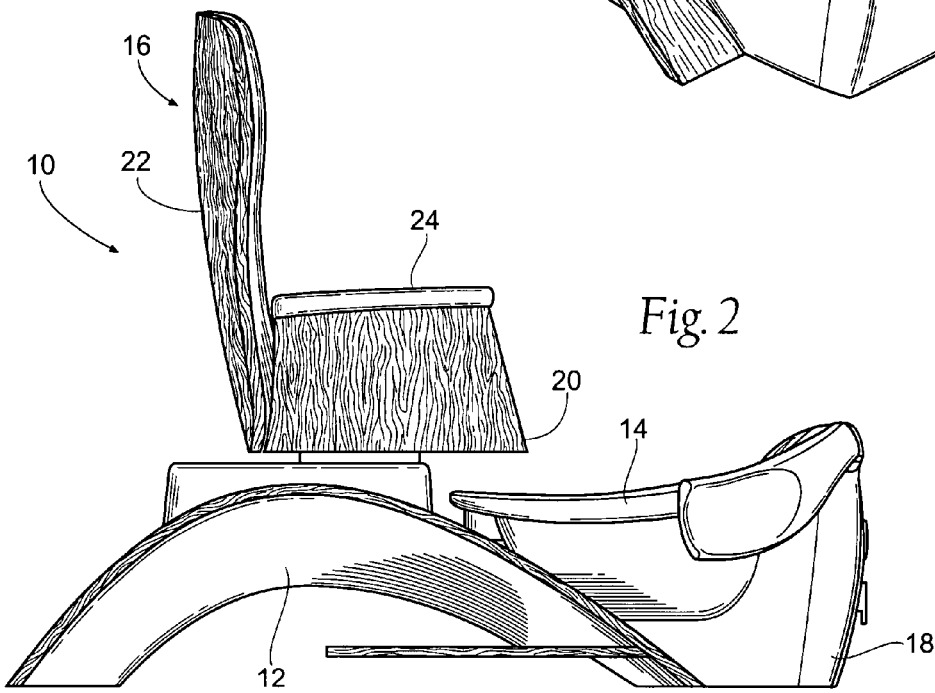
FIG. 2 is a side plan view of a foot spa of FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

The spa apparatus 10 of the present invention preferably includes a frame 12, a basin 14, and a chair 16. The spa apparatus 10 is configured for use in foot massages, pedicures, and other activities related to the feet, including bathing, soaking, simulating, etc.

The basin 14 is adapted to retain treatment fluid, generally water, for use with various cleaning or massage activities, as is known in the art. The basin 14 preferably includes a base portion 18. In the preferred embodiment, the basin 14 and the base portion 18 are integrally formed, however, it is contemplated that these parts could be formed separately. The basin 14 may be coupled to the frame 12.

The chair 16 is also coupled to the frame 12. The chair 16 includes a seat 20, a backrest 22, and a pair of armrests 24. The chair 16 sits adjacent and above the basin 14, such that the feet of a person sitting in the chair 16 extend into the basin 14.

In the illustrated embodiment the chair 16 comprises a rigid backrest 23 coupled to a rigid seat portion 21. In the illustrated embodiment the rigid armrests 25 are integrally formed with the rigid seat portion 21, however it is contemplated that the rigid armrests 25 could be separately formed and coupled to the rigid seat portion 21. The backrest 22, seat 20, and armrests 24 are preferably cushioned for the comfort of the user. A cushioned backrest 26 may be coupled to the rigid backrest 23. A cushioned seat 28 may be coupled to the rigid seat portion 21. A pair of cushioned armrests 30 may be coupled to the pair of rigid armrests 25. In the preferred embodiment the cushioned armrests 22 are integrally formed to the cushioned seat 28. It is also contemplated that the cushioned backrest 26 could be integrally formed to the cushioned seat 28.

The chair 16 is preferably adjustably coupled to the frame 12. The chair 16 is preferably adapted to swivel left to right to allow a user to easily enter and exit the chair 16. The chair 16 is preferably also adapted to move forward and backward with respect to the frame 12 and to tilt forward and backward with respect to the frame 12 to provide additional comfort to a user and to properly position a user's feet for receiving a spa treatment.

The chair 16 is preferably rotatably coupled to a movable platform 32. The chair 16 may be rotatably coupled to the platform 32 using any means known in the art. In the illustrated embodiment the chair 16 is rotatably coupled to the platform 32 by a swiveling mechanism 34 as is known in the art.

Figure 4:
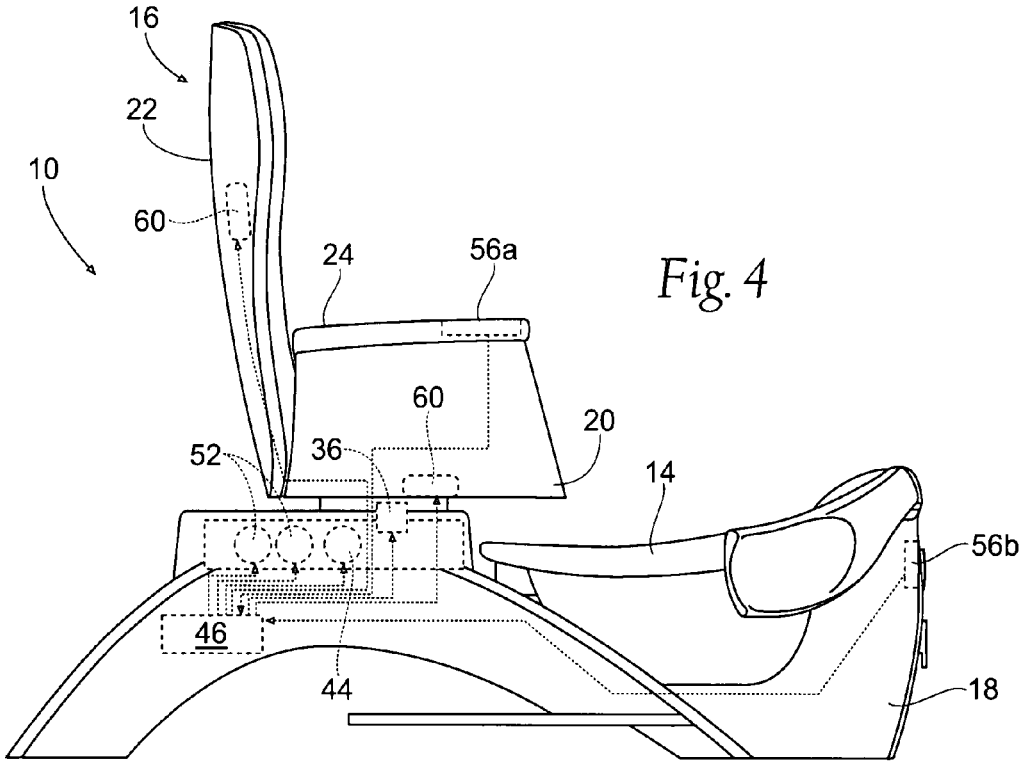
FIG. 4 is a simplified side plan view of the foot spa of FIG. 1 showing the control system.
Figure 5:
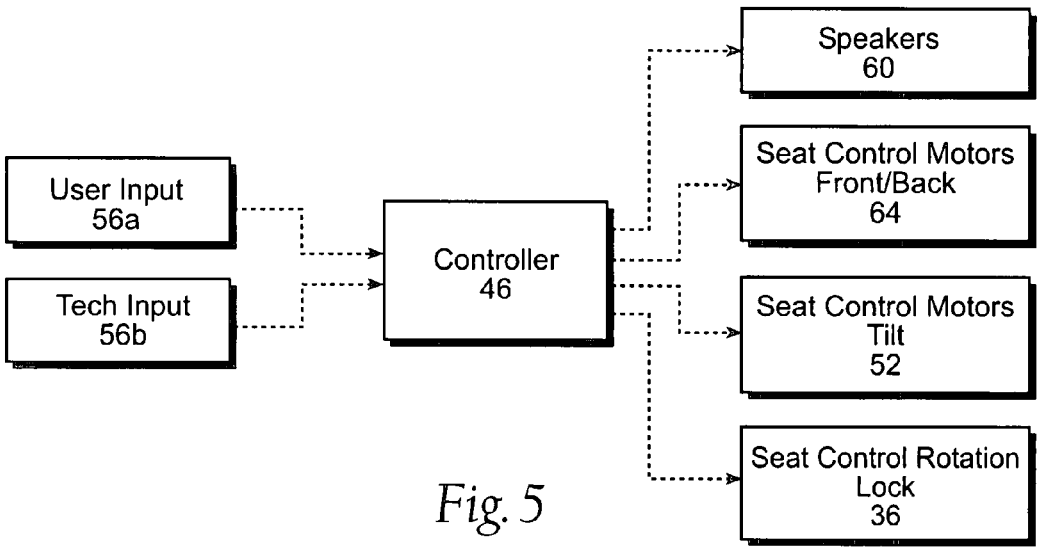
FIG. 5 is a simplified diagram of the control system of the foot spa of FIG. 1.
Figure 6:
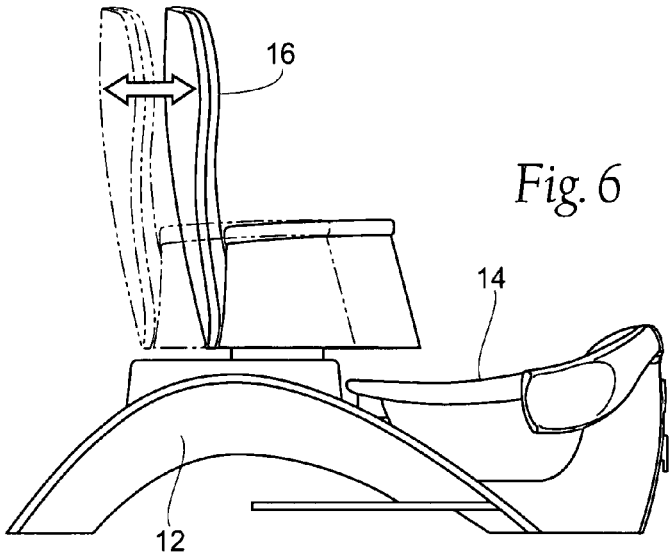
FIG. 6 is a simplified side plan view showing the lateral movement of the chair of the spa device of FIG. 1.
Figure 7:
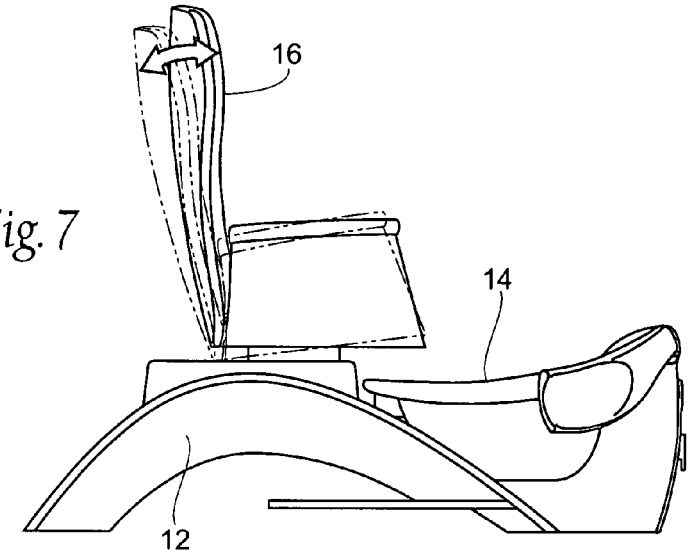
FIG. 7 is a simplified side plan view showing the tilting of the chair of the spa device of FIG. 1.
Figure 8:
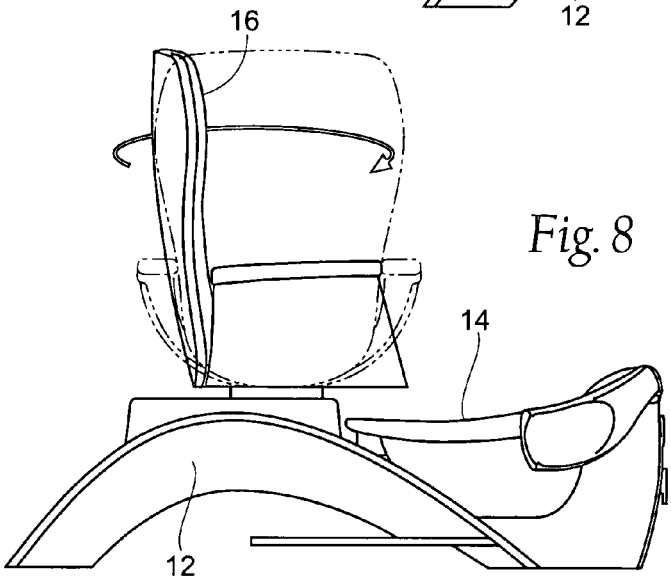
FIG. 8 is a simplified side plan view showing the rotation of the chair of the spa device of FIG. 1.

As shown in FIG. 4 it is further contemplated that the swiveling device 34 may include a locking mechanism 34 disposed on the swiveling mechanism 34. The locking mechanism 34 is of the type known in the art. In this manner, the chair 16 may be locked from rotation prior to tiling the chair 16 for the safety of a user seated in the chair 16. The locking mechanism is preferably coupled to the controller 46 such that the locking mechanism is controlled by the controller 46 based on input from a user interface 56.

The platform 32 is coupled to the frame 12 through a motion device 38 adapted to move the platform 32 relative to the frame 12. Such motion devices 38 are known in the automobile industry and may be used to couple automobile seats to automobile chassis. In the illustrated embodiment, the chair 16 can move forward and backward by the slidable engagement of a pair of movable rails 40, which are fixed to the platform 32, with a pair of stationary rails 42 fixed to the motion device 38. The platform 32 is slid forward and backward by a motor 44 associated with the pair of movable rails 40. The motor 44 is preferably in electronic communication with a controller 46, as will be described in more detail below, and movement of the platform 32 is thereby controlled by said controller 46.

The motion device 38 is also adapted to tilt the platform 32, and thus the chair 16, relative to the frame 12. The motion device 38 includes a pair of arm members 48 coupled to the motion device 38 through a pivoting member 50. The pivoting member 50 pivots by engagement with a pair of motors 52. As the pivoting member 50 rotates, the arm members 48 are rotated, thus tilting the platform 32. The pair of motors 52 are preferably in electronic communication with a controller 46, as will be described in more detail below, and movement of the platform 32 is thereby controlled by said controller 46.

Although the means for tilting the seat and moving the sear forward and backward in the illustrated embodiment comprises a plurality of electric motors 44, 52, it is also contemplated that other devices could be utilized including, but not limited to solenoids or linear actuators.

The spa apparatus 10 preferably has a control system 54 including at least one controller 46 and at least one user interface 56. The user interface 56 is in electronic communication with the at least one controller 46. The user interface 56 is preferably adapted to accept input from a user and transmit that input to the controller 46 to operate the spa apparatus 10. The illustrated embodiment preferably includes two user interfaces 56, a client interface 56*a* and a technician interface 56*b*. It is contemplated that at least one of the user interfaces 56 and the controller 46 may be formed separately, or may be integrally formed.

The client interface 56*a* controls the motion of the chair 16 in the front to back position and the tilting position. The client interface 56*a* further controls the rotation lock 36. In the illustrated embodiment, the client interface 56*a* preferably includes a single button or switch 58 which returns the chair 16 to a preset position. In this manner, the chair 16 may be returned to the preset position prior to a user attempting to exit the chair 16. In the illustrated embodiment, the client interface 56*a* is built in to the armrest 24 of the chair 16. However, it is contemplated that the client interface 56*a* could be separate from the chair 16. For example, the client interface 56*a* could be a remote control. The client interface 56*a* is in electronic communication, either directly or indirectly, with the controller 46. The electronic communication between the client interface 56*a* and the controller 46 may be wired or wireless.

The spa apparatus 10 preferable includes a technician interface 56*b*. The technician interface 56*b* controls the motion of the chair 16 in the front to back position and also the tilting position. The technician interface 56*b* allows the technician to correctly position a client while administering a spa treatment. In the illustrated embodiment, the technician interface 56*b* is built in to the base 18 of the basin 14. However, it is contemplated that the technician interface 56*b* could be separate from the basin 14. For example, the technician interface 56*b* could be a remote control. The technician interface 56*b* is in electronic communication, either directly or indirectly, with a controller 46. The electronic communication between the technician interface 56*b* the controller 46 may be wired or wireless.

In use, a user enters input at a user interface 56. A signal is sent from the user interface 56 to the controller 46. A signal is then sent from the controller 46 to the appropriate electric motor 44, 52 to operate the chair 16 as directed by the user input.

As described above, the user interface 56 preferably includes a single button or switch 58 which returns the chair 16 to a preset position so that the user can safely exit the chair 16. In use, when the user presses the preset return button 58, a signal is sent to the controller 46. The controller 46 then sends signals to the motors 52 controlling the tilt of the chair 16 to return the chair 16 to the preset tilt position. The controller 46 preferably also sends a signal to the motor 44 controlling the forward/backward movement of the chair 16 to return the chair 16 to the preset front/back position.

Figure 3:
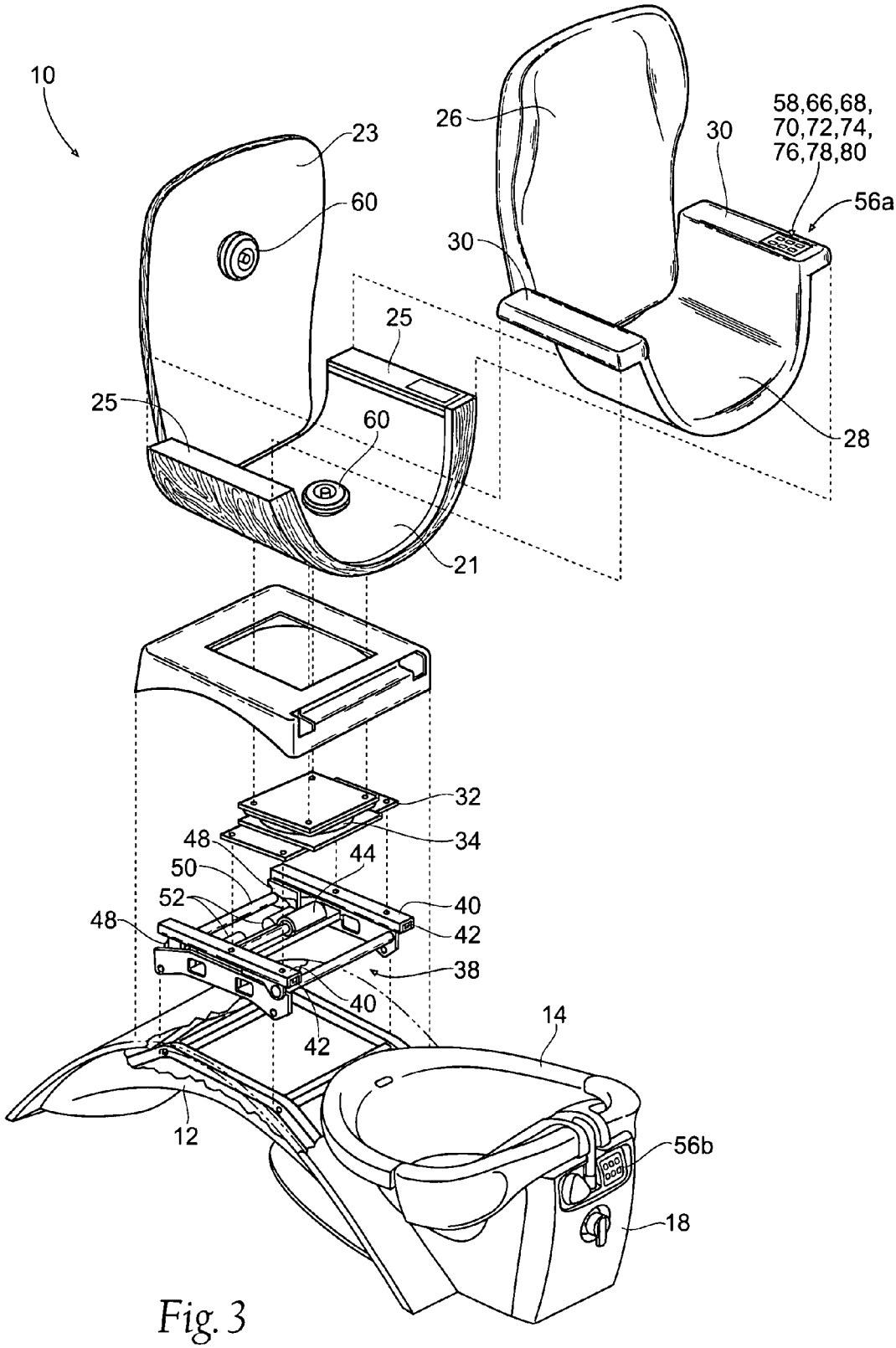
FIG. 3 is a partially exploded view of the foot spa of the present invention.

The spa device 10 may further be provided with acoustic resonance therapy devices such as those manufactured by So Sound Solutions of Lafayette, Colo. The acoustic resonance therapy may include tactile immersion sound delivery. Tactile immersion sound delivery includes a device for delivering the therapy such as a transducer 60. In the preferred embodiment the transducer may comprise a speaker-like device. However, it is contemplated that the transducer 60 may take any other forms known in the art. The transducer 60 may provide tactile vibrations, or both sound and tactile vibrations. As shown in FIG. 3, the transducer 60 is provided in the chair 16 and provides both sound and tactile vibrations which are absorbed into the body and mind when a user sits in the chair 16. The massaging resonance from the transducers 60 may stimulate the body's natural relaxation response, reduce stress, enhance enjoyment, and supporting overall physical, mental, emotional, and relational well-being.

As shown in FIG. 3, the chair 16 includes a sound system 62 including at least one transducer 60 positioned within the chair 16. The chair 16 preferably includes at least one transducer 60 coupled to the seat 20 of the chair 16 and at least one transducer 60 coupled to in the backrest 22 of the chair 16. In the illustrated embodiment a first transducer 60 is coupled to the rigid back portion 23 while a second transducer 60 is coupled to the rigid seat portion 21. The sound system 62 may include an amplifier (not shown) which is in electronic communication, either directly or indirectly, with the transducers 60. The amplifier (not shown) may be in electronic communication, either directly or indirectly with a controller 46. The electronic communications may be wired or wireless. The transducers 60 may be of any type known in the art.

The controller 46 is preferably in electronic communication, either directly or indirectly, with at one user interface 56. In the illustrated embodiment, a single user interface 56*a* may be used to provide input to control both the transducers 60 and the motion of the chair 16. In the illustrated embodiment this user interface 56*a* is coupled or built into an armrest 24 of the chair 16. However, it is contemplated that the user interface 56*a* could be separate from the chair 16. It is also contemplated that the user interface 56*a* for entering input to control the transducers 60 could be formed separately from the user interface 56*a* used to enter input to control the motion of the chair 16.

The user interface 56*a* preferably includes means for at least adjusting the volume 66 and turning the power on and off 68. These means for adjusting the volume 66 and turning the power on and off 68 may be any type known in the art including, but not limited to a button or switch. In the illustrated embodiment, the user interface 56*a* further includes a stop button 70, a play button 72, a forward button 74, and a reverse button 76. The user interface 56*a* in the illustrated embodiment also preferably includes a headphone volume control 78 and a so-sound vibration level control 80.

The sounds system 62 preferably includes prerecorded sounds, such as music, stored within the system 62 to be transmitted through the transducers 60. The sound system 62 may include a microprocessor to store and plan the prerecorded music. It is further contemplated that it may be desirable to provide the sounds system 62 with an input (not shown) to connect an external music device, such as an MP3 player to the sound system 60. It is further contemplated that the sound system may include a connector (not shown) for connecting a pair of headphones to the system 62.

In use, the user enters input at the user interface 56. A signal is sent from the user interface 56 to the controller 46. A signal is then sent from the controller 46 to the sound system 62 to operate the sound system 62 as directed by the user input.

All electronic communications can be wired or wireless. The various controllers discussed above 46 maybe a single controller 46 or several separate controllers 46.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. In a spa system comprising:

a chair;

a movable platform coupled to the chair;

a motion device coupled to the movable platform and operably connected to a controller;

an elongated supporting frame comprising adjacent first and second longitudinal portions, said first portion coupled to and supporting the motion device, said second portion being provided with a pair of forward extending, laterally spaced, supporting leg members;

an independently fabricated foot-receiving and treatment basin coupled to and supported by said second portion of said supporting frame, and embraced by said pair of forward extending leg members;

means for swiveling said chair to allow a user to enter and to exit the chair, said means including a rotatable platform coupled between said frame and said chair thereby supporting said chair on said frame;

means for sliding said chair relative to said frame, said means for sliding said chair relative to said frame comprising a first pair of rails coupled to said movable platform and a second pair of rails coupled to the motion device, said second pair of rails sized and configured for slidable engagement with said first pair of rails;

means for tilting said chair relative to the frame and to said basin, said tilting means comprising a pivoting member coupled to the motion device, and a pair of arm members, each of said arm members having a first end coupled to the pivoting member and a second end coupled to one of the second pair of rails;

at least one controller operably connected to the motion device and adapted to operate the motion device;

at least one operator input device operably connected to the controller and adapted to provide input to the controller; and at least one power source operably connected to the controller.

2. The spa system of claim 1 further comprising at least one motor coupled to the first pair of rails and operably connected to the controller.

3. The spa system of claim 2 wherein said controller is adapted to operate the at least one motor to operate the motion device.

4. The spa system of claim 1 wherein said motion device further comprises:

at least one motor coupled to the pivoting member and operably connected to the controller.

5. The spa system of claim 1 further comprising:

at least one tactile immersion sound delivery device coupled to the chair and operably connected to a controller; and wherein the controller is adapted to operate the at least one tactile immersion sound delivery device.

6. The spa system of claim 5 wherein the chair comprises a seat portion and a back portion coupled to the seat portion.

7. The spa system of claim 6 wherein a first tactile immersion sound delivery device is coupled to the seat portion; and wherein a second tactile immersion sound delivery device is coupled to the back portion.

8. The spa system of claim 1 wherein the operator input device is coupled to the chair.

9. The spa device of claim 8 wherein the operator input device is adapted to provide input to the controller to operate both the motion device and a tactile immersion sound delivery device.

10. The spa system of claim 8 further comprising a second operator input device coupled to the basin, said second operator input device adapted to provide input to the controller to operate the motion device.

* * * * *